United States Patent [19]

Goi et al.

[11] Patent Number: 4,744,468

[45] Date of Patent: May 17, 1988

[54] CIRCULATION-TYPE BILL RECEIVING AND DISPENSING MACHINE

[75] Inventors: Kowichi Goi; Junichi Arikawa; Hiroshi Emori; Hiroshi Kinoshita, all of Tokyo, Japan

[73] Assignee: Laurel Bank Machine Co., Ltd., Tokyo, Japan

[21] Appl. No.: 666,369

[22] Filed: Oct. 30, 1984

[30] Foreign Application Priority Data

Nov. 4, 1983 [JP] Japan ..... 58-207284
Nov. 4, 1983 [JP] Japan ..... 58-207285
Nov. 4, 1983 [JP] Japan ..... 58-207286

[51] Int. Cl.[4] ..... B07C 5/34

[52] U.S. Cl. ..... 209/534; 194/206; 235/379; 271/3.1

[58] Field of Search ..... 209/534; 235/379, 381; 271/3, 3.1, 4, 9; 221/21, 252; 194/206, 207; 109/24.1

[56] References Cited

U.S. PATENT DOCUMENTS 4,343,582 8/1982 Lundblad et al. ..... 414/32
4,365,700 12/1982 Arimoto et al. ..... 194/206
4,369,360 1/1983 Tsuji ..... 235/379
4,465,192 8/1984 Ohba et al. ..... 209/534
4,465,193 8/1984 Kokubo et al. ..... 209/534
4,510,380 4/1985 Uchida et al. ..... 194/206
4,511,795 4/1985 Wood et al. ..... 235/379
4,577,763 3/1986 Placke et al. ..... 209/534

FOREIGN PATENT DOCUMENTS

EP109743 5/1984 European Pat. Off. ..... 209/534
56-63664 5/1981 Japan ..... 235/379
56-94464 7/1981 Japan ..... 235/379
57-75371 5/1982 Japan ..... 235/379
2100906 1/1983 United Kingdom ..... 194/206

*Primary Examiner*—Robert B. Reeves
*Assistant Examiner*—Edward M. Wacyra
*Attorney, Agent, or Firm*—Fleit, Jacobson, Cohn & Price

[57] ABSTRACT

A circulation-type bill receiving and dispensing machine has a receiving mode, a dispensing mode and a distributing mode. Two sets of dealing part mechanisms are provided for permitting two tellers to simultaneously use the machine. Each dealing part mechanism is in communication with a commonly used received bill handling route for received mode and a commonly used dispensing bill handling route for dispensing mode. The received bill handling route is in communication with boxes for accumulating bills therein and sending the bills therefrom. The boxes are in communication with the dispensing bill handling route.

6 Claims, 15 Drawing Sheets

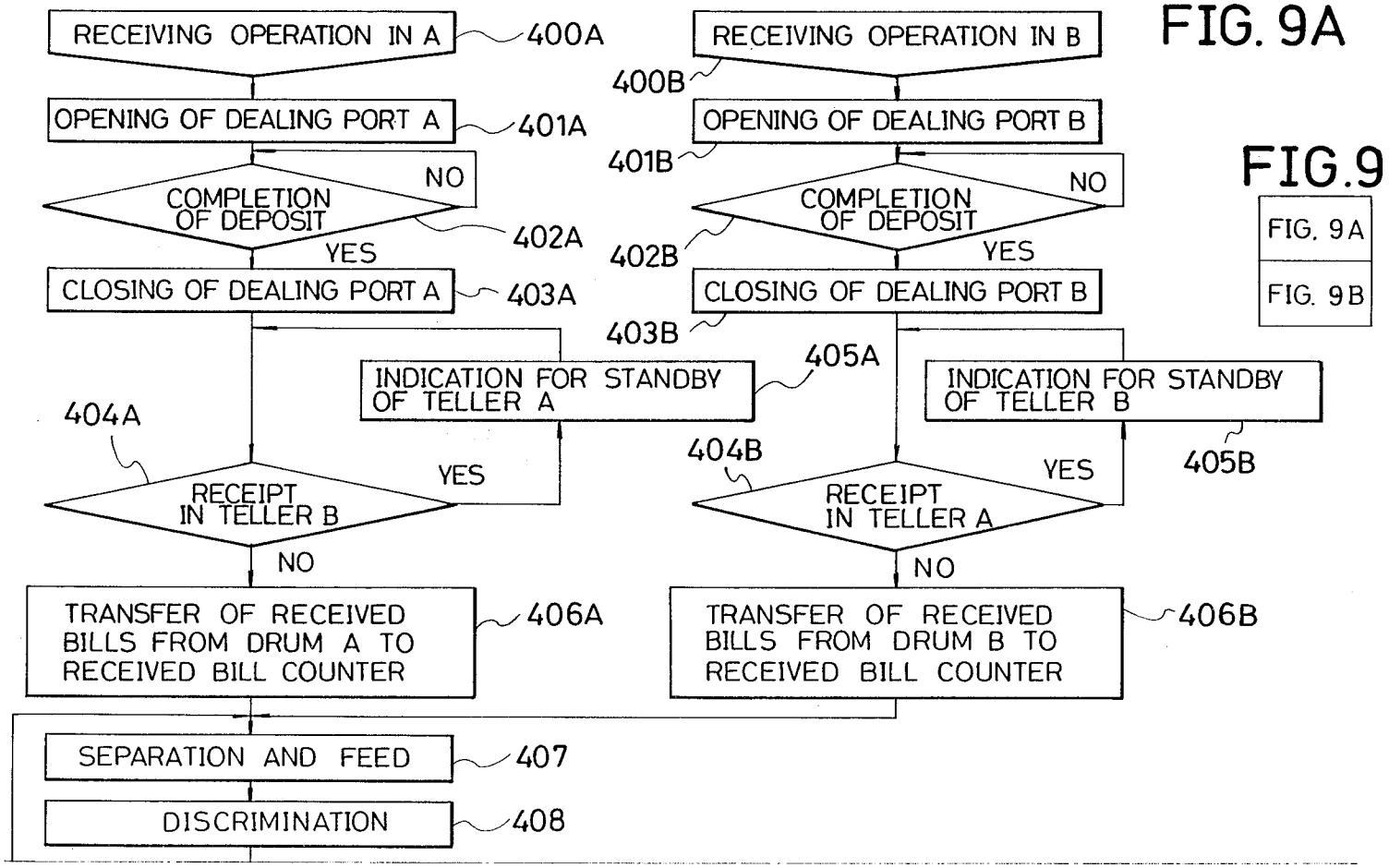
FIG. 9A
FIG. 9
FIG. 9A
FIG. 9B
RECEIVING OPERATION IN B
OPENING OF DEALING PORT B
COMPLETION OF DEPOSIT
NO
YES
CLOSING OF DEALING PORT B
INDICATION FOR STANDBY OF TELLER B
RECEIPT IN TELLER A
YES
NO
TRANSFER OF RECEIVED BILLS FROM DRUM B TO RECEIVED BILL COUNTER
400B
401B
402B
403B
404B
405B
406B
405A
INDICATION FOR STANDBY OF TELLER A
RECEIVING OPERATION IN A
OPENING OF DEALING PORT A
COMPLETION OF DEPOSIT
NO
YES
CLOSING OF DEALING PORT A
RECEIPT IN TELLER B
YES
NO
TRANSFER OF RECEIVED BILLS FROM DRUM A TO RECEIVED BILL COUNTER
SEPARATION AND FEED
DISCRIMINATION
400A
401A
402A
403A
404A
406A
407
408

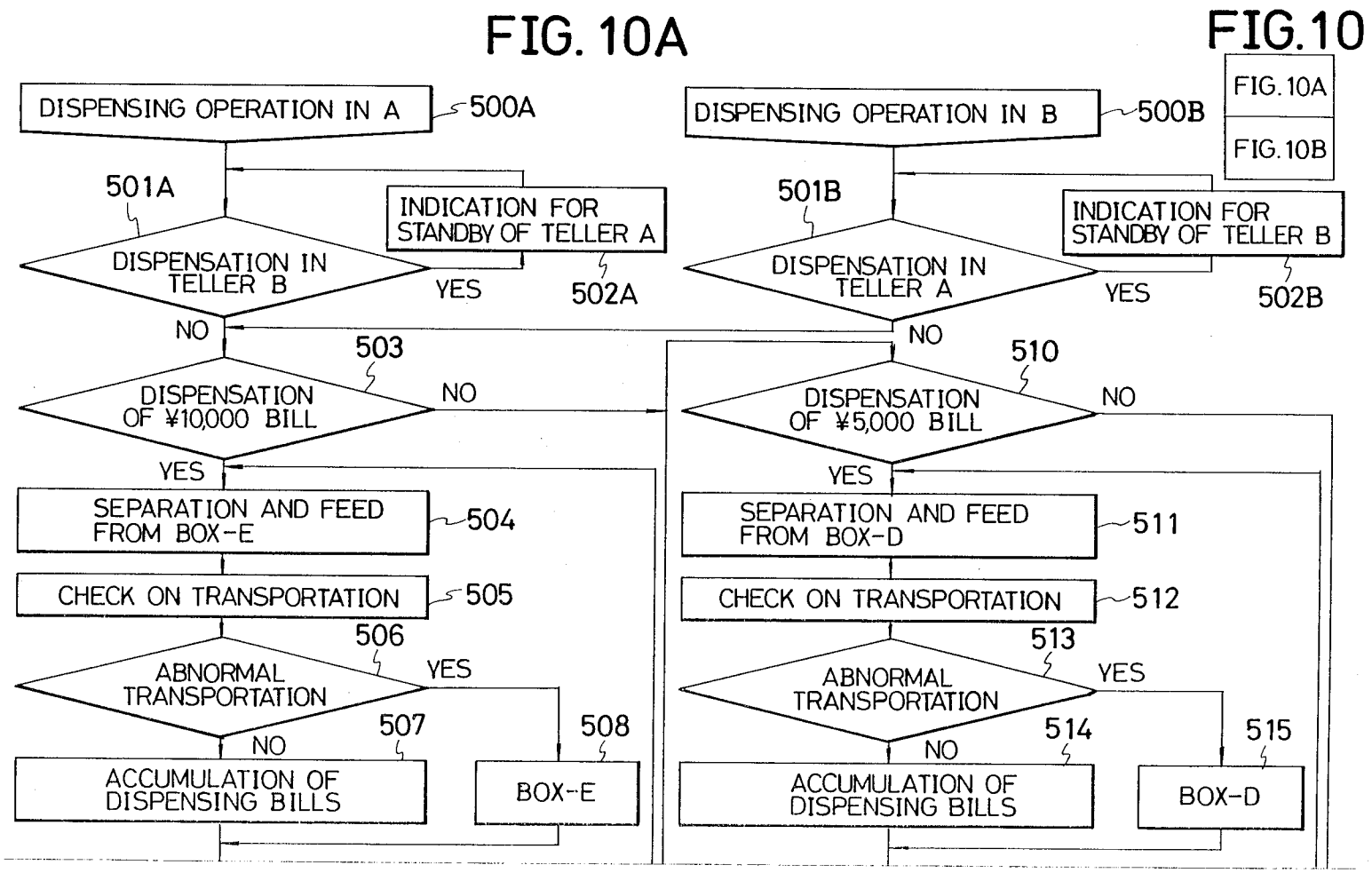
FIG. 10
FIG. 10A
FIG. 10B
FIG. 10A
500A
DISPENSING OPERATION IN A
501A
DISPENSATION IN TELLER B
YES
NO
INDICATION FOR STANDBY OF TELLER A
502A
503
DISPENSATION OF ¥10,000 BILL
YES
NO
504
SEPARATION AND FEED FROM BOX-E
505
CHECK ON TRANSPORTATION
506
ABNORMAL TRANSPORTATION
YES
NO
507
ACCUMULATION OF DISPENSING BILLS
508
BOX-E
500B
DISPENSING OPERATION IN B
501B
DISPENSATION IN TELLER A
YES
NO
INDICATION FOR STANDBY OF TELLER B
502B
510
DISPENSATION OF ¥5,000 BILL
YES
NO
511
SEPARATION AND FEED FROM BOX-D
512
CHECK ON TRANSPORTATION
513
ABNORMAL TRANSPORTATION
YES
NO
514
ACCUMULATION OF DISPENSING BILLS
515
BOX-D

CIRCULATION-TYPE BILL RECEIVING AND DISPENSING MACHINE

BACKGROUND OF THE INVENTION

The present invention relates to a circulation-type bill receiving and dispensing machine which performs the receiving and dispensing of bills or bank notes and, at the same time, has circulating and distributing functions that permit the bills to be reused as ones for dispensation.

Heretofore, there was already known a circulation-type bill receiving and dispensing machine which is capable of performing the receiving and dispensing of bills and, at the same time, has circulating and distributing functions that permit the received bills to be reused as ones for dispensation.

However, a conventional circulating-type bill receiving and dispensing machine has not been able to perform the dispensing operation when the machine is performing a receiving operation.

In addition, the conventional machines have not been able to simultaneously perform two receiving operations or two dispensing operations.

SUMMARY OF THE INVENTION

An object of the invention is, therefore, to provide a circulation-type bill receiving and dispensing machine which is capable of simultaneously performing both receiving and dispensing operations; and more particularly, a machine capable of performing a dispensing operation when the machine is performing a receiving operation, and vice versa. Consequently, the machine permits two tellers at a counter of a financial institution such as a bank to simultaneously instruct the machine to carry out receiving and dispensing operations, respectively.

Another object of the invention is to provide a circulation-type bill receiving and dispensing machine which is capable of simultaneously performing two receiving operations or two dispensing operations.

According to the invention, there is provided a circulation-type bill receiving and dispensing machine having a receiving mode, a dispensing mode, and a distributing mode, comprising:

(a) a dealing port mechanism which is capable of handling bills among a dealing port communicating with the outside of said machine, a receiving port communicating with a received bill handling route inside said machine, and a dispensing port communicating with a dispensing bill handling route inside said machine;

(b) said received bill handling route which separates, transports and discriminates bills after receiving them from said dealing port mechanism and, at the same time, permits the distribution of bills being transported according to the results of said discrimination;

(c) a plurality of box bodies which are capable of accumulating bills distributed by said received-bill handling route or accumulating and separating and feeding the bills; and (d) said dispensing bill handling route which is capable of transporting bills from a plurality of box bodies capable of accumulating, separating and feeding bills, and, at the same time, is capable of transferring the bills to said dispensing port after accumulating the bills being transferred, thereby enabling the simultaneous handling of receiving and dispensing operations.

DESCRIPTION OF THE DRAWINGS

Other objects and advantages of the present invention will become apparent from the following description made with reference to the accompanying drawing, in which:

FIGS. 3C1 to 3C4 illustrate an operation in which bills in a received-bill distributing box are distributed;

FIGS. 4A and 4B illustrate the arrangement in which two sets of dealing port mechanisms are provided; in which FIG. 4A illustrates the condition of movement of bills in the receiving mode; and FIG. 4B illustrates the condition of movement of bills in the dispensing mode;

FIG. 9 shows the arrangement of FIGS. 9A and 9B;

FIGS. 9A and 9B are flowcharts in the receiving mode;

FIG. 10 shows the arrangement of FIGS. 10A and 10B;

FIGS. 10A and 10B are flow charts in the dispensing mode; and

DESCRIPTION OF THE PREFERRED EMBODIMENT

One embodiment of the present invention will be now described in detail with reference to the accompanying drawings.

Figure 1:
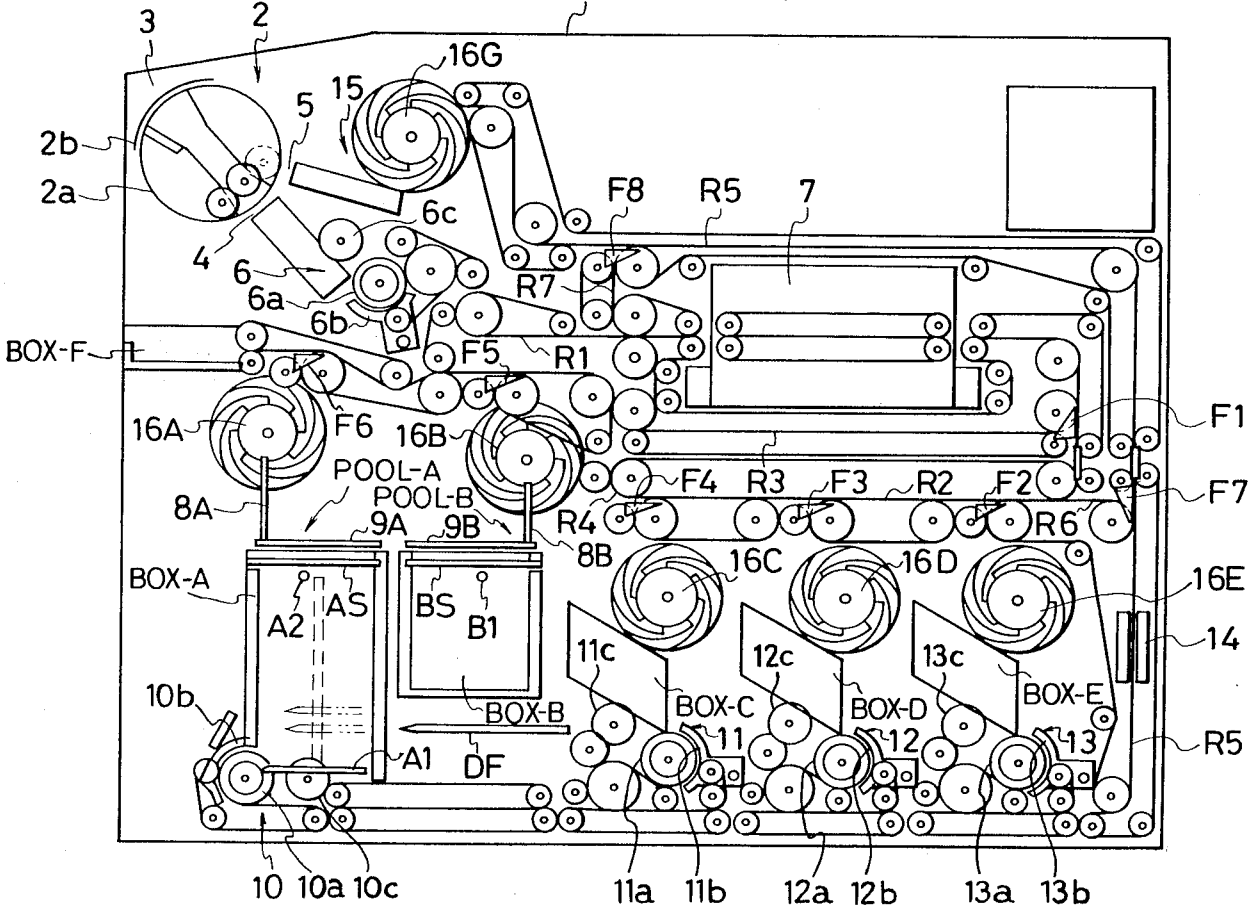
FIG. 1 is a schematic diagram illustrating an embodiment of a circulation-type bill receiving and dispensing machine to which this invention is applied.
Figure 2:
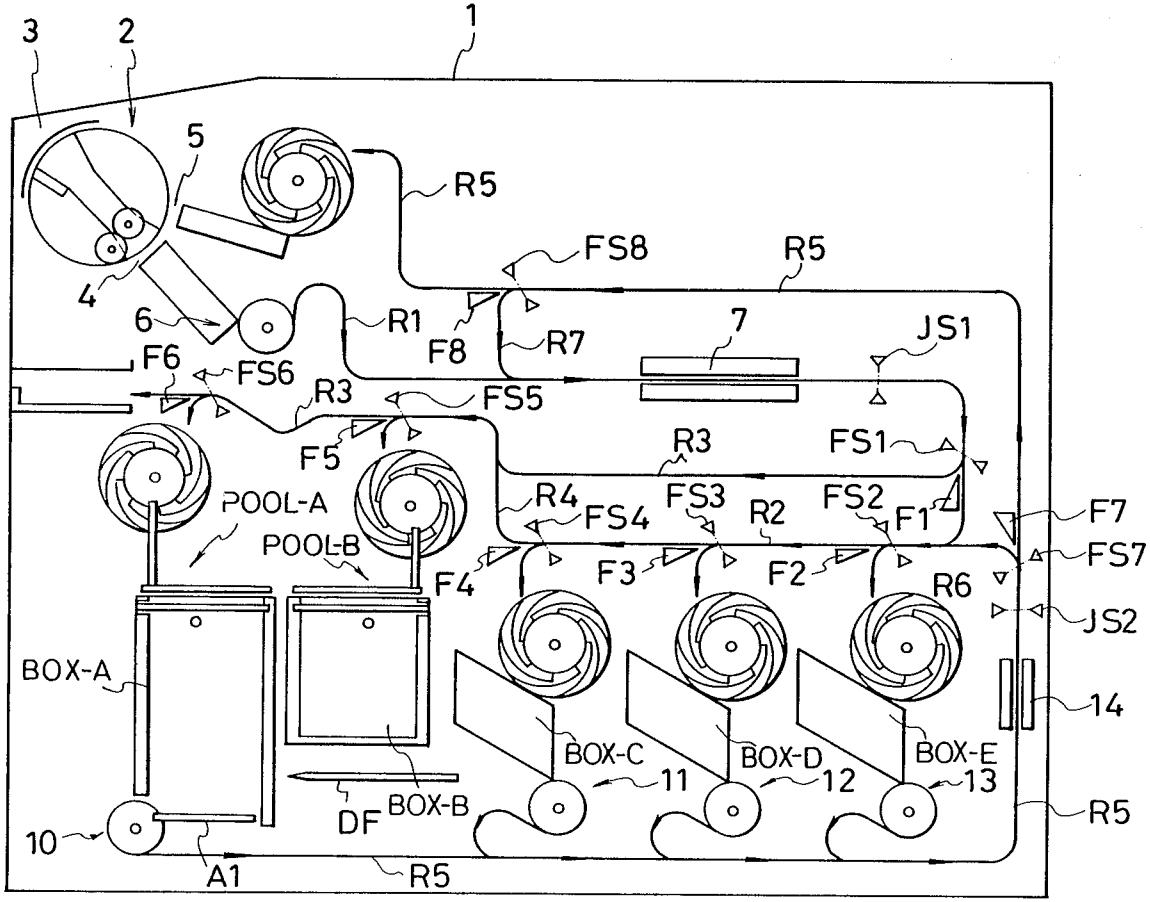
FIG. 2 is a route diagram illustrating the route along which bills flow through each constituent section shown in FIG. 1.

FIG. 1 is a schematic drawing illustrating an embodiment of the circulation-type bill receiving and dispensing machine, to which this invention is applied. FIG. 2 is a route drawing showing the flow of bills through the respective constituent sections shown in FIG. 1.

In the figures, the reference numeral 1 denotes a circulation-type bill receiving and dispensing machine body, while the reference numeral 2 denotes a dealing port mechanism. The dealing port mechanism 2 includes a cylindrically shaped dealing drum 2*a* and a shutter 2*b* for opening and closing this dealing drum 2*a* in relation to the outside of the machine. An opening is formed in the front and in the rear of the dealing drum 2*a*. Furthermore, the arrangement of the dealing drum 2*a* is such that one opening communicates with a dealing port 3, which is opened or closed by the shutter 2*b*. Also, the dealing drum 2*a* is rotatably installed in such a way that its other opening communicates with a receiving port 4 or a dispensing port 5, which will be described later.

In the rear of the receiving port 4 is provided a received-bill counter 6. Bills deposited into the dealing drum 2a are sent to the received-bill counter 6 via the receiving port 4. The received-bill-counter 6 is constituted by a friction-type separating and feeding mechanism, and has a reed roller 6a, a separating member 6b, and a feed roller 6c.

Bills separated and fed from the received-bill counter 6 are transported along a received-bill handling route R1. A discriminating detector 7 is provided midway along the received-bill handling route R1, and is adapted to judge the genuineness and type of the bills, the obverse from the reverse side, bill damage, etc. of the fed bills.

The received-bill handling route R1 in the rear of the discriminating detector 7 is switched to a distributing route R2 or a received-bill distributing route R3 by a distributing fork F1.

Three forks F2, F3 and F4 are provided in the distributing route R2. Bills distributed by the distributing forks F2, F3, and F4 are accumulated and housed in a ten-thousand-yen box Box-E, a five-thousand-yen box Box-D, and a one-thousand-yen box Box-C, respectively.

Additionally, the rear end portion of the distributing route R2 constitutes a mechanical clearing route R4 connected thereto so as to return to the received-bill distributing route R3.

On the other hand, two distributing forks F5 and F6 are provided in the vicinity of the rear end portion of the received-bill distributing route R3. Bills distributed by the distributing forks F5 and F6 are accumulated in a temporary pool Pool-B and a temporary pool Pool-A. At the same time, bills which were not distributed by the distributing forks F5 and F6 are sent to a received-bill returning portion Box-F so as to return to the teller.

The temporary pools Pool-A and Pool-B are each constituted by horizontally movable bill-scraping plates 8A and 8B and bill-pooling plates 9A and 9B.

Additionally, a received-bill distributing box Box-A and a damaged-bill box Box-B for accumulating and housing the bills accumulated in the temporary pools Pool-A and Pool-B are provided immediately below the temporary pools Pool-A and Pool-B.

The received-bill distributing box Box-A and the damaged bill box Box-B are integrally formed, and are detachable with respect to the circulation-type bill receiving and dispensing machine body 1. The received-bill distributing box Box-A, and the damaged-bill box Box-B have openable covers AS and BS, respectively, so as to form safes. Each openable cover AS and BS is horizontally openable in synchronism with the bill-pooling plates 9A and 9B or independently thereof.

Figure 3A:
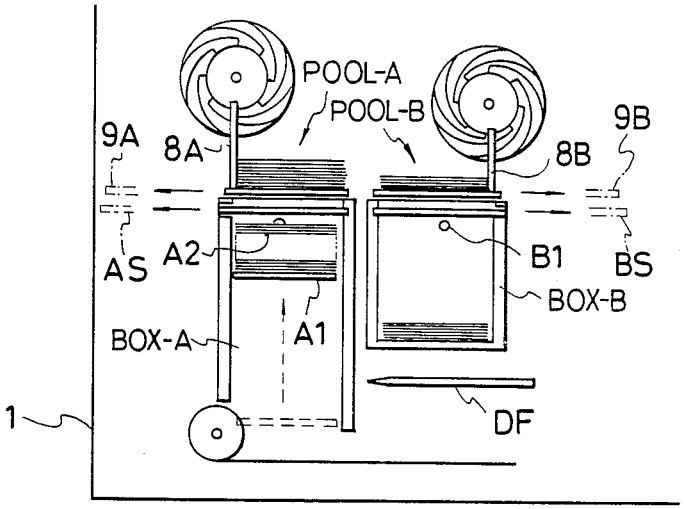
FIG. 3A illustrates an operation in which accumulated bills inside two temporary pools are received in a received-bill distributing box and a damaged-bill box.
Figure 3B:
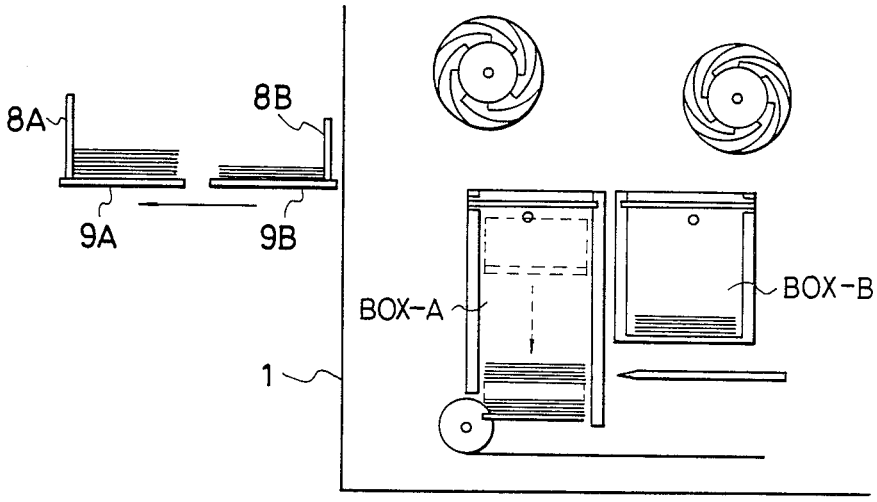
FIG. 3B illustrates an operation in which the accumulated bills are pulled out from the machine together with the boxes to effect a returning operation.

Bills accumulated in the temporary pools Pool-A and Pool-B can be housed in the received-bill distributing box Box-A and the damaged bill box Box-B, respectively, as the bill-pooling plates 9A and 9B and the openable covers AS and BS move horizontally together, as shown in FIG. 3A. At the same time, when an instruction for return is issued, both the temporary pools Pool-A and Pool-B are pulled outside the machine so as to effect the returning process, as shown in FIG. 3B. Furthermore, in the case of the distributing mode, as shown particularly in FIGS. 3C3 and 3C4, bills in the temporary pool Pool-A are first housed in the received-bill distributing box Box-A as the bill-pooling plate 9A and the openable cover AS move horizontally in synchronism. Then, the bill-scraping plate 8B and the bill-pooling plate 9B synchronously move horizontally onto the received-bill distributing box Box-A. Further, bills accumulated in the temporary pool Pool-B are controlled so that the bills can be housed in the received-bill distributing box Box-A as only the bill-pooling plate 9B moves first to its original position.

The received-bill distributing box Box-A, the one-thousand-yen box Box-C, the five-thousand-yen box Box-D, and the ten-thousand-yen box Box-E are capable of housing bills and, at the same time, are capable of separating and feeding the housed bills.

In other words, friction-type separating and feeding mechanisms 10, 11, 12 and 13 are provided for box Box-A, and Box-C–Box-E. Each separating and feeding mechanism 10–13 has a feed roller 10a–13a, a separating member 10b–13b, and a kick-out roller 10c–13c, as in the case of the received-bill counter 6.

Also, the maximum number of bills to be housed in the received-bill distributing box Box-A is designed to be greater than the total of the maximum number of bills contained in each one-thousand-yen box Box-C, five-thousand-yen box Box-D, and ten-thousand-yen box Box-E.

Since the maximum number of bills housed in the received-bill distributing box Box-A is high, the bill-mounting plate A1 of said box is adapted to be vertically movable inside the box. At the time of housing bills accumulated from the temporary pool Pool-A, the bill-mounting plate A1 moves upward. At the time of separating and feeding the accumulated bills by means of the separating and feeding mechanism 10, the bill-mounting plate A1 is lowered to its lowermost position.

An upper-position-detecting hole A2 is provided in the vicinity of the upper housing-limit position of the received-bill distributing box Box-A. The upward movement of the bill-mounting plate A1 is stopped when the upper surface of bills on the bill-mounting plate A1 reaches the upper-position-detecting hole A2.

On the other hand, a full-load-detecting hole B1 is provided in the vicinity of the upper housing-limit position of the damaged-bill box Box-B. When bills are housed at least to the full-load-detecting hole B1, only the receiving operation is interrupted so as to effect the replacement of the box or recovery of bills.

Additionally, a dividing fork DF is provided adjacent to the received-bill distributing box Box-A and below the damaged-bill box Box-B. At the time of distributing bills from the received-bill distributing box Box-A, the dividing fork DF is inserted into the box Box-A and then moves slightly upward so as to effect smooth movement of the separating and feeding operations of bills.

Next, bills which are separated and fed by each separating and feeding mechanism 10–13 are transported by a dispensing-bill handling route R5. Midway in the dispensing-bill handling route R5 is provided a dispensing-bill-transportation detector 14 so as to judge the abnormalities in the transportation of bills being transported (e.g., double feed, diagonal feed, and proximity feed).

A dispensing-bill-accumulating portion 15 is provided at the end of the dispensing-bill handling route R5. Dispensed bills accumulated in the dispensing-bill-accumulating portion 15 are sent to the dealing-port mechanism 2 via the dispensing port 5. The teller takes out the bills from the dealing port 3 and pays them to the customer.

A dispensation-retry route R6 and a distributing fork F7 are provided midway in the dispensing-bill handling route R5, at a position immediately after the dispensing-bill-transportation detector 14, so that bills that are judged as falling under the case of abnormal transportation can be transmitted to the starting side of the distributing route R2.

Also, a distribution and transmission route R7 and a distributing fork F8 are provided in the vicinity of the end of the dispensing-bill handling route R5, so that bills being transported can be transferred from the dispensing-bill handling route R5 to the front stage position of the discriminating detector 7 of the received-bill handling route R1.

Accumulating wheels 16A–16E and 16G are each provided at the temporary pool Pool-A, temporary pool Pool-B, one-thousand-yen-bill box Box-C, five-thousand-yen-bill box Box-D, ten-thousand-yen-bill box Box-E, and dispensing-bill-accumulating portion 15, so that bills can be accumulated in an arranged condition. In FIG. 2, JS1 and JS2 denote discrimination-timing sensors, which are provided to allow the discriminating detector 7 and the dispensing-bill-transportation detector 14 to obtain the timing of outputting the results of judgment of bills.

Furthermore, FS1–FS8 denote fork sensors, which are provided to obtain the timing for changing over the distributing forks F1–F8 according to the destination of the subsequent bills being transported.

Figure 4A:
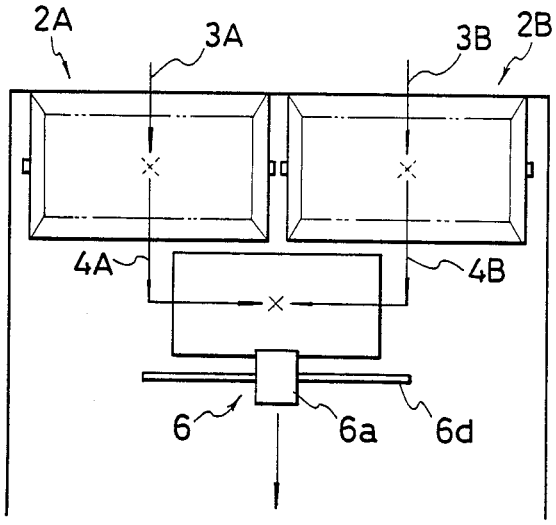
Figure 4B:
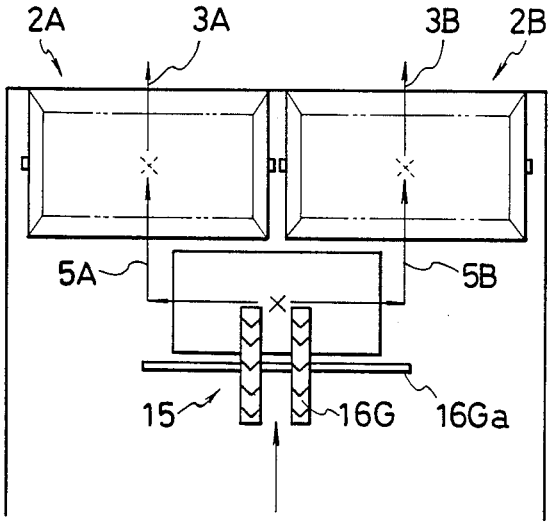

FIGS. 4A and 4B show schematic diagrams in the case where two sets of the dealing port mechanism 2 are installed, so that two tellers can perform the receiving operation using one circulation-type bill-receiving and dispensing machine. FIG. 4A shows the movement of bills in the receiving mode, while FIG. 4B the movement of bills in the dispensing mode.

In the figures, the reference numeral **6*d* shows the driving shaft of a feed roller 6*a*, and the reference numeral 16Ga shows the drive shaft of an accumulating wheel 16G**.

Figure 5:
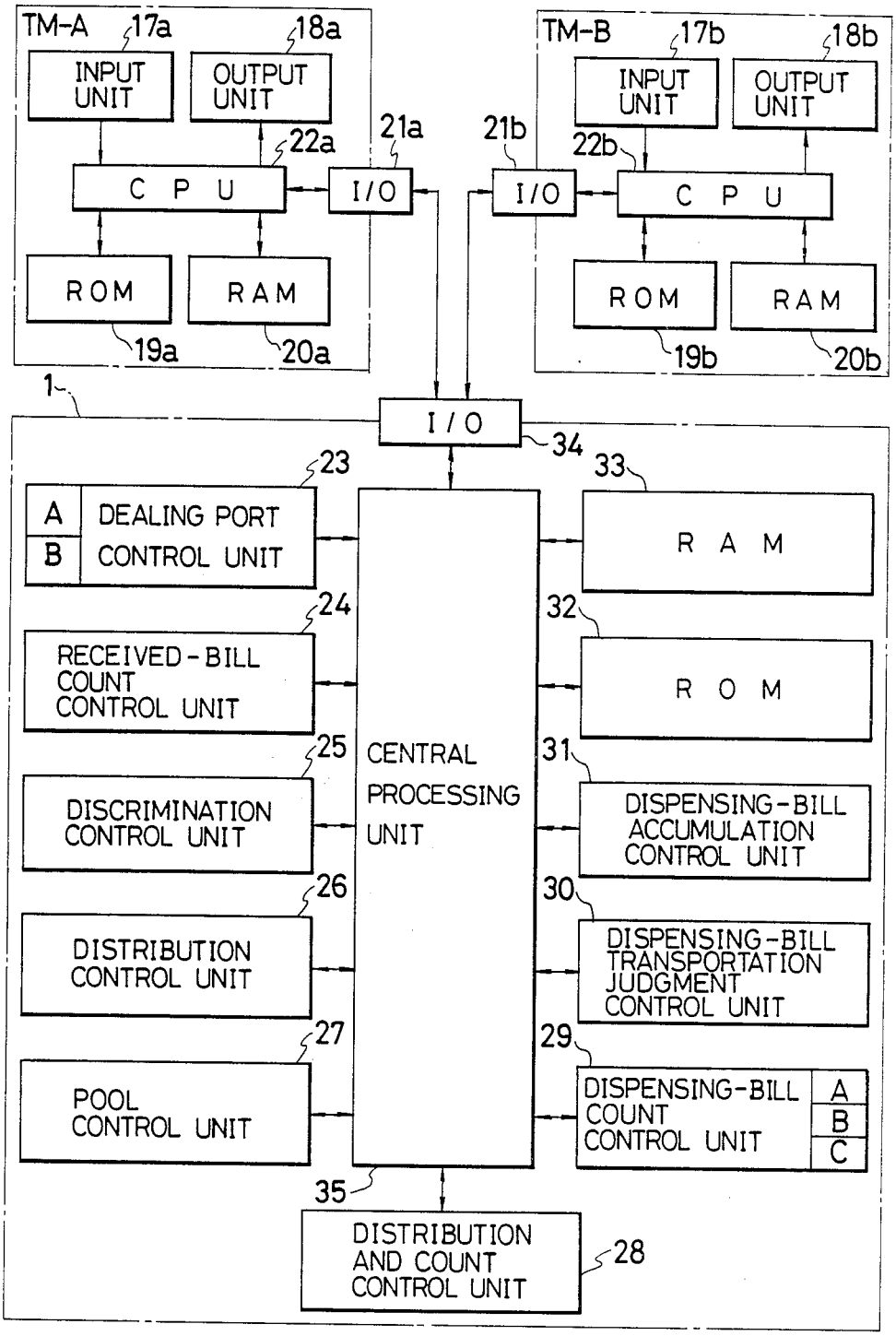
FIG. 5 is a control block diagram.

FIG. 5 shows a control block diagram for the circulation-type bill receiving and dispensing machine according to the present invention.

In the figure, TM-A and TM-B show account controlling apparatuses, co-called teller's machines, which are provided for two tellers.

The teller's machines TM-A and TM-B are respectively comprised of the following: an input unit **17*a* and 17*b* for inputing accounting data; an output unit 18*a* and 18*b* for indicating and printing out various types of alarm; ROM 19*a* and 19*b* for memorizing an account controlling program, etc.; RAM 20*a* and 20*b* for operating and memorizing various data according to the programs; I/O 21*a* and 21*b* for inputting and outputting data between the teller's machine and the CPU in the circulation-type bill receiving and dispensing machine body; and CPU 22*a* and 22*b*** for controlling the input unit, output unit, ROM, RAM and I/O according to the program.

On the other hand, the circulation-type bill-receiving and dispensing machine 1 is comprised of the following: a dealing-port control unit 23 for driving and controlling the dealing port mechanism 2; a received-bill-counter control unit 24 for driving and controlling the received-bill counter 6; a discrimination control unit 25 for judging and controlling the genuineness and type of the bills, and obverse from the reverse side, damage, etc. of bills being transported by means of the detecting signal of the discriminating detector 7; a distribution control unit 26 for controlling the driving of the distributing forks F1–F8; a pool control unit 27 for controlling the driving of the temporary pools Pool-A and Pool-B; a distribution-counter controller 28 for controlling the driving of the dividing fork DF and the separating and feeding mechanism 10 at the time of the distribution mode; a dispensing-bill-counter control unit 29 for controlling the driving of the separating and feeding mechanisms 11–13; a dispensing-bill-transportation-judgment control unit 30 for controlling the judgment of abnormal transportation and the like of bills being transported by means of the detecting signal of the dispensing-bill-transportation detector 14; a dispensing-bill-accumulating-portion control unit 31 for controlling the driving of the dispensing-bill-accumulating portion; ROM 32 for controlling each of the control units 23 to 31 according to the program shown in a flow chart, which will be described later; RAM 33 for effecting operations, memorization, etc., of various data; I/O 34 for inputting and outputting data between the teller's machines TM-A and TM-B; and the central processing unit (CPU) for controlling each controller, ROM, RAM and I/O.

Referring now to the flow charts shown in FIG. 6 through FIG. 11, description will be made of each operation of the circulation-type bill-receiving and dispensing machine according to the present invention.

Figure 6:
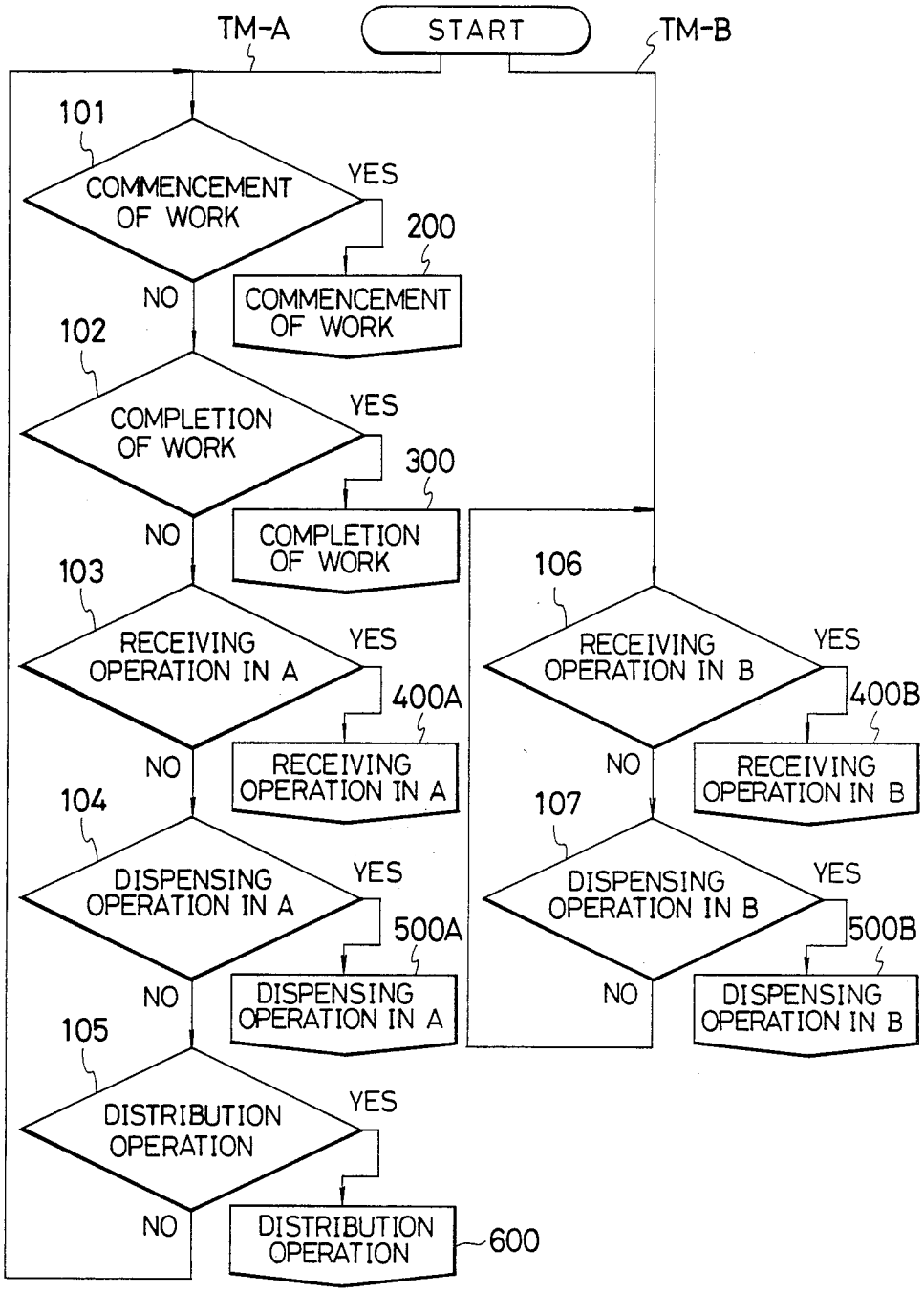
FIG. 6 is a flow chart of main control on the teller's machine side.

FIG. 6 shows the main control flow chart for the teller's machine.

With respect to the teller's machines TM-A and TM-B and the circulation-type bill receiving and dispensing machine, the following flow chart is executed after power is supplied thereto.

Account Control

Steps 101 through 105 show the controlling operation for the teller's machine TM-A.

Step 101:

Judgment is made as to whether or not an instruction has been issued to set bills for payment in the circulation-type bill-receiving and dispensing machine before commencement of work. If a commencement-of-work operation setting button (not shown) is depressed, the operation proceeds to the commencement-of-work operation flow chart 200, and, if the button is not pressed, proceeds to Step 102.

Step 102:

Judgment is made as to whether or not an instruction has been issued to collect bills for payment in the received-bill distributing box Box-A. If a completion of work collection operation button (not shown) is depressed, the operation proceeds to the completion-of-work operation flow chart 300, and, if the button is not pressed, proceeds to Step 103.

Step 103:

Judgment is made as to whether or not an instruction for the receiving operation has been issued. If a paying-in button is depressed, the operation proceeds to Step 400A in the receiving operation flow chart 400, and if the button is not pressed, proceeds to Step 104.

Step 104:

Judgment is made as to whether or not an instruction for the dispensing operation has been issued. If a dispensing operation button (not shown) is depressed, the operation proceeds to Step 500A in the dispensing operation flow chart 400, and if the button is not pressed, proceeds to Step 105.

Step 105:

When there are no customers during business activity (when neither of the two tellers has instructed the receiving or dispensing operation), or when the number of bills for payment in any of the ten-thousand-yen-bill box Box-E, five-thousand-yen-bill box Box-D, and one-thousand-yen-bill box Box-C has decreased below the prescribed number (it is also possible to confine the case to the ten-thousand-yen-bill box Box-E), if a distributing operation button (not shown) is depressed or a judgment is automatically made, the operation proceeds to the distribution operation flow chart 600, and if the button is not pressed, proceeds to Step 101.

Step 106 and Step 107 show the controlling operation for the teller's machine TM-B.

Step 106:

Judgment is made as to whether or not an instruction for the receiving operation has been issued in the teller's machine TM-B. If the receiving operation button (not shown) is depressed, the operation proceeds to Step 400B in the receiving operation flow chart 400, and, if the button is not pressed, proceeds to Step 107.

Step 107:

Judgment is made as to whether or not an instruction for the dispensing operation has been issued in the teller's machine TM-B. If the dispensing operation button (not shown) is depressed, the operation proceeds to Step 500B in the dispensing operation flow chart 500, and, if the button is not pressed, returns to Step 106.

Figure 7:
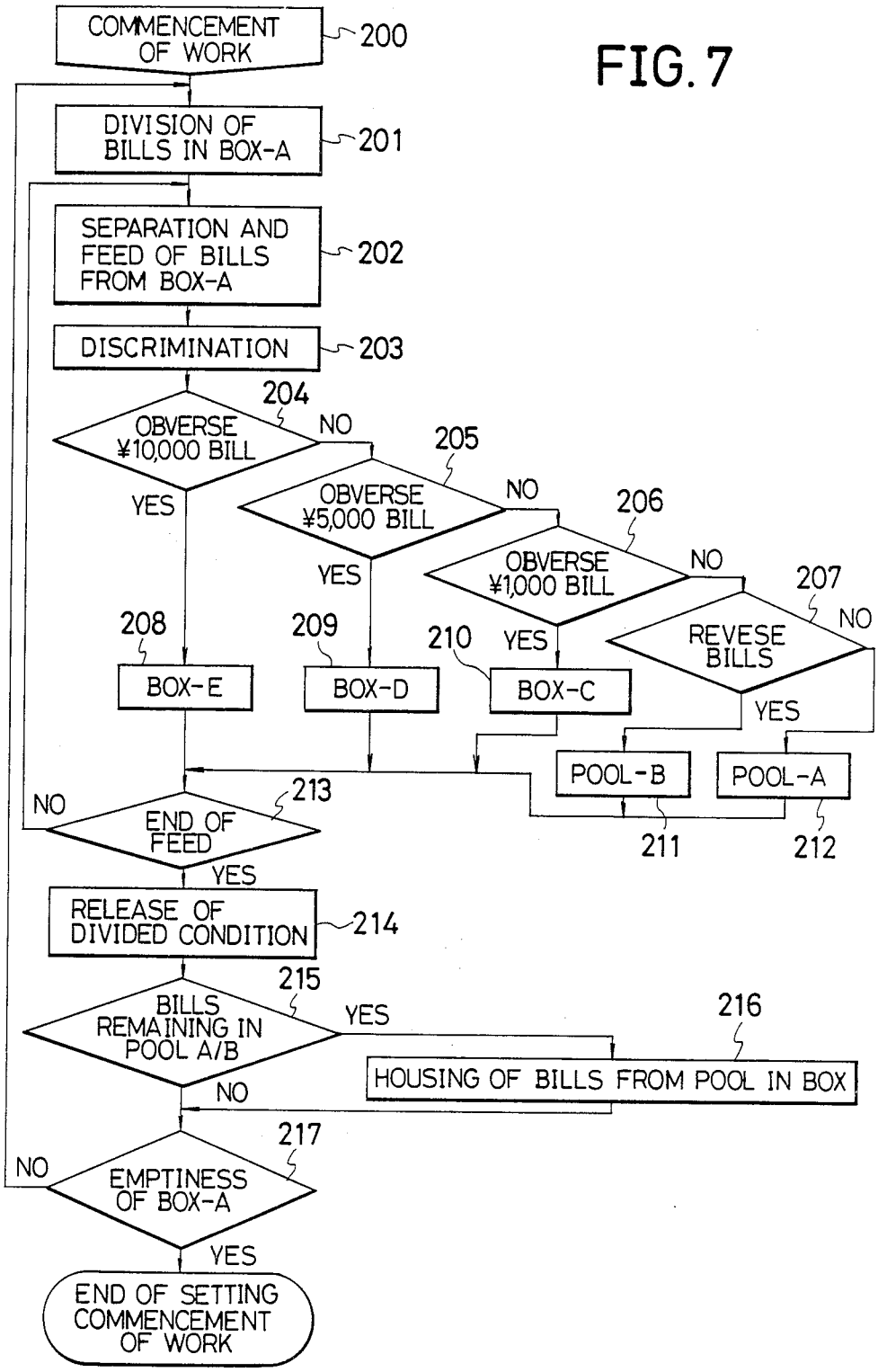
FIG. 7 is a flow chart at the time of setting operation start for a circulation-type bill receiving and dispensing machine.

FIG. 7 shows a flow chart at the time of setting the commencement-of-work operation for the circulation-type bill-receiving and dispensing machine.

Setting of Commencement-of-Work Operation

Figures 1, 3C:
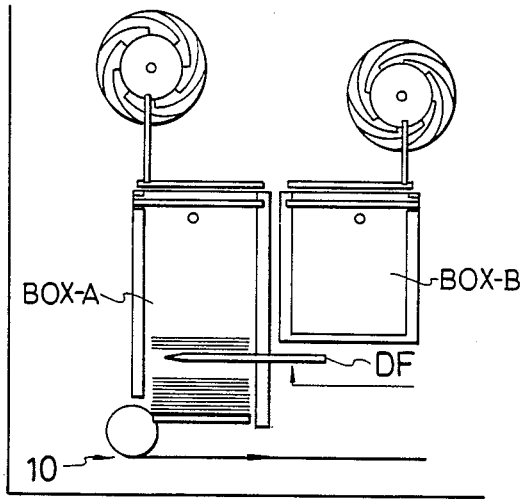
Figures 2, 3C:
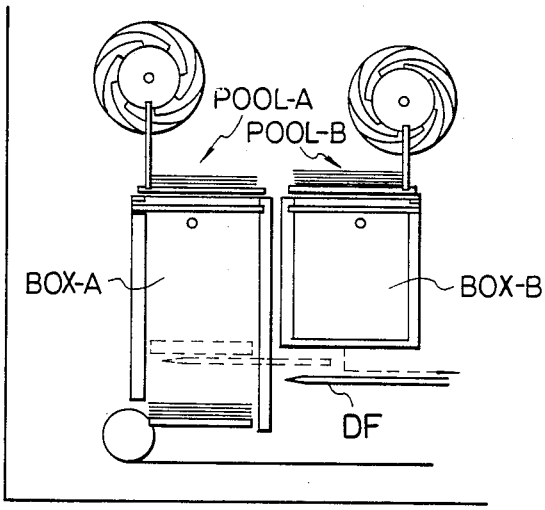

Step 201:

Before distributing bills in the received-bill-distributing box Box-A into each box Box-C to Box-E, bills in the receiving box Box-A are divided into appropriate volumes by means of the dividing fork DF, as shown in FIG. 3C1.

Step 202:

Bills to be distributed which were divided into appropriate volumes by means of the dividing fork DF are separated and fed one by one.

Step 203:

Bills thus separated and fed are sent to the discriminating detector 7 via the dispensing-bill handling route R5 and the distribution and transfer route R7, and the types of bill and the obverse from the reverse side of the bills being transported are judged.

Step 204:

If a ten-thousand-yen bill showing the obverse side is detected among the bills being transported, the operation proceeds to Step 208, and, in other cases, proceeds to Step 205.

Step 205:

If a five-thousand-yen bill showing the obverse side is detected among the bills being transported, the operation proceeds to Step 209, and, in other cases, proceeds to Step 206.

Step 206:

If a one-thousand-yen bill showing the obverse side is detected among the bills being transported, the operation proceeds to Step 210, and, in other cases, proceeds to Step 207.

Step 207:

If a bill showing the reverse side is detected among the bills being transported, the operation proceeds to Step 211, and, in other cases, proceeds to 212.

Step 208:

Ten-thousand-yen bills showing the obverse side in Step 204 are housed and accumulated in the ten-thousand-yen-bill box Box-E, and then the operation proceeds to Step 213.

Step 209:

Five-thousand-yen bills showing the obverse side in Step 205 are housed and accumulated in the five-thousand-yen-bill bo Box-D, and then the operation proceeds to Step 213.

Step 210:

One-thousand-yen bills showing the obverse side in Step 206 are housed and accumulated in the one-thousand-yen-bill box, and then the operation proceeds to Step 213.

Step 211:

All the bills showing the reverse side in Step 207 are accumulated in the temporary pool Pool-B, and the operation then proceeds to Step 213.

Step 212:

All the bills that failed to fall under the requirements specified in any of Steps 204 through 207, for example, abnormally transported bills, are accumulated in the temporary pool Pool-A, and the operation then proceeds to Step 213.

Step 213:

Judgment is made as to whether or not all the bills to be distributed that have been divided in appropriate volumes by means of the dividing fork DF in Step 201 have been separated and fed. If distribution is completed, the operation proceeds to Step 214, and, if not, returns to Step 202.

Step 214:

The dividing fork DF as it is inserted inside the received-bill distribution box Box-A is pulled out of the received-bill distribution box Box-A and returns to its original position (refer to FIG. 3C2).

Step 215:

Judgment is made as to whether or not any bills which were not distributed into the boxes Box-C to Box-E remain in the temporary pool Pool-A or Pool-B. If any bills remain in any of the temporary pools Pool-A and Pool-B, the operation proceeds to Step 216, and, if not, proceeds to Step 217.

Figures 3, 3C:
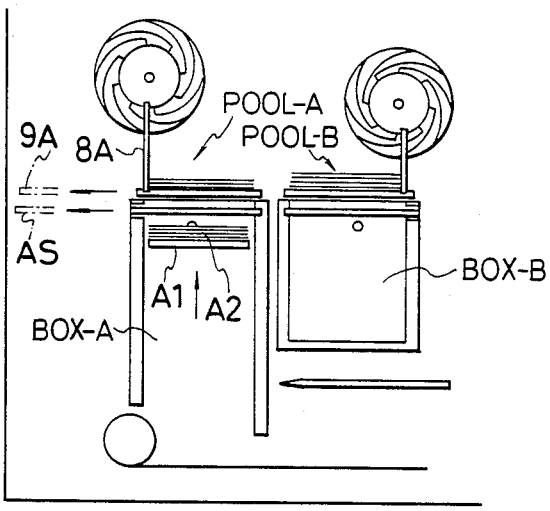
Figures 3, 3C, 4:
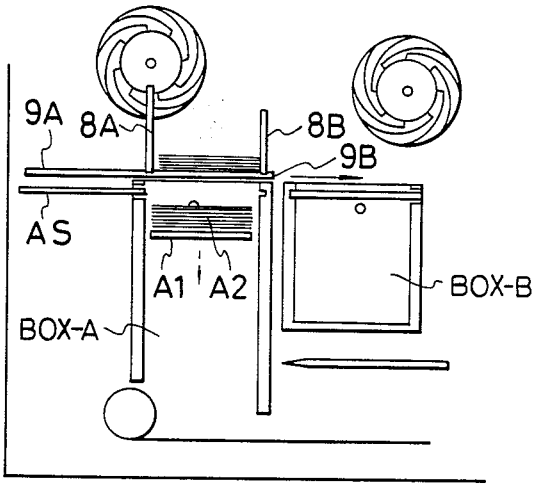

Step 216:

If any bills remain in the temporary pool Pool-A or Pool-B in Step 215, bills that have not been distributed are collected by raising the bill-mounting plate A1, as shown in FIGS. 3C3 and 3C4. In this case, reverse bills are inverted to the obverse side as they are accumulated in the temporary pool Pool-B, and the bills are distributed in the subsequent transportation.

Step 217:

Judgment is made as to whether or not there are bills inside the received-bill-distributing box Box-A after the bill-mounting plate A1 is lowered to its lowermost position. If it is judged that there are no bills and distribution is completed, the flow chart for setting the commencement-of-work operation is completed, and in other cases the operation returns to Step 201 and continues until all the bills inside the received-bill distributing box Box-A are distributed.

Figure 8:
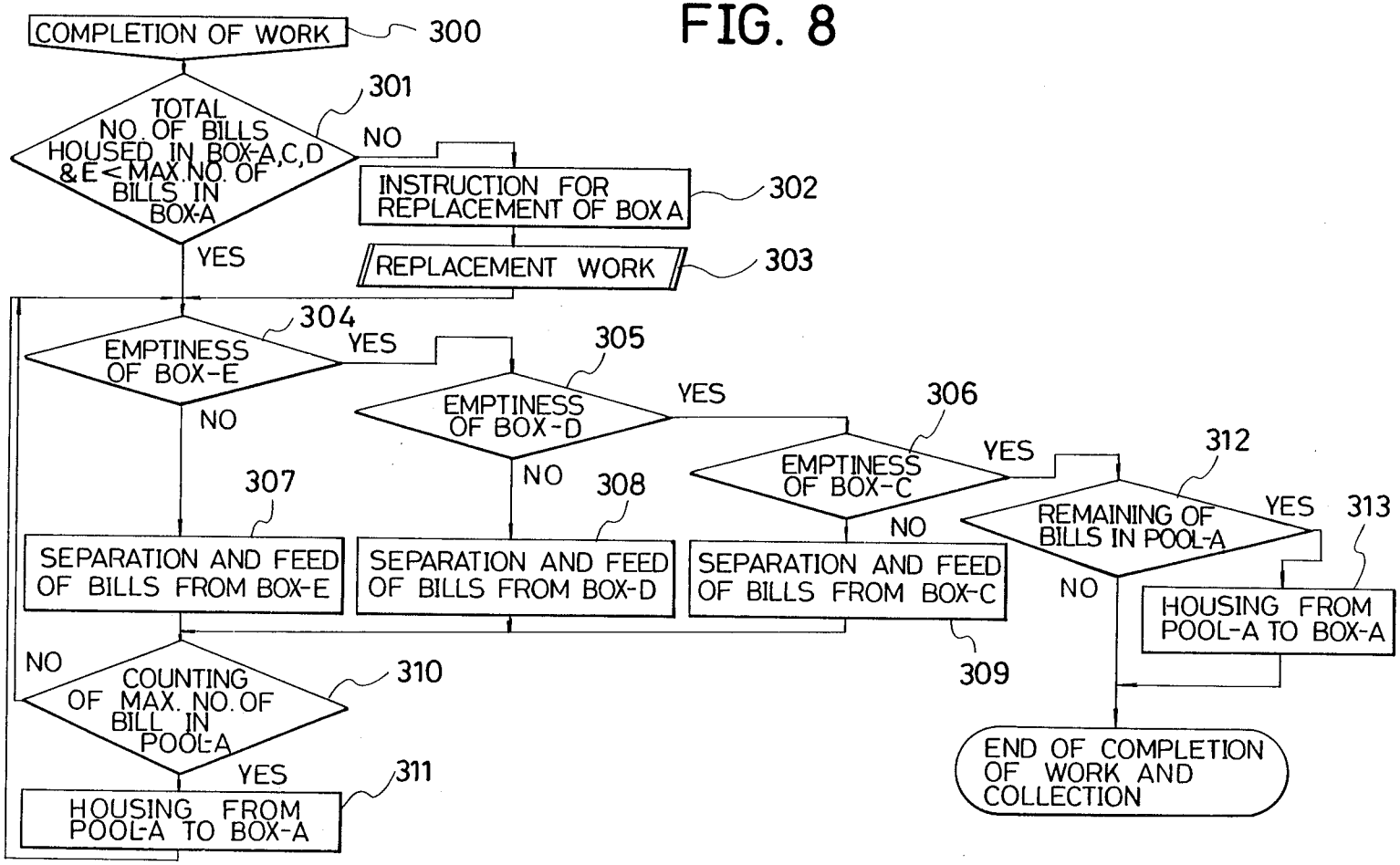
FIG. 8 is a flow chart at the time of completion of operation and collection.

FIG. 8 shows a flow chart at the time of completion-of-work and collection operation for the circulation-type bill-receiving and dispensing machine.

Completion of Work and Collection

Step 301:

First, the total number of bills housed in the received-bill distributing box Box-A, one-thousand-yen box Box-C, five-thousand-yen box Box-D, ten-thousand-yen box Box-E is calculated, and comparison is made between that total and the maximum number of bills able to be housed in the distributing box Box-A. Then, judgment is made as to whether or not it is possible to house all the bills in the circulation-type bill-receiving and dispensing machine in the paid-in-bill distribution box Box-A. If it is judged that the bills can be housed, the operation proceeds to Step 304, and, if not, proceeds to Step 302.

Step 302:

An instruction (indication) is issued to the output unit 18*a* of the teller's machine TM-A to the effect that the completion of work and collection are impossible and that the receive-bill distributing box Box-A should be replaced.

Step 303:

A teller (or personnel in charge of cash/safe management) performs the operation of replacing the received-bill distributing box Box-A. After completion of the replacement work, the operation proceeds to Step 304 automatically or by operating a button or the like.

Step 304:

Judgment is made as to whether or not bills for payment still remain inside the ten-thousand-yen-bill box Box-E. If they remain, the operation proceeds to Step 307, and, if not, proceeds to Step 305.

Step 305:

Judgment is made as to whether or not bills for payment still remain inside the five-thousand-yen-bill box Box-D. If they remain, the operation proceeds to Step 308, and, if not, proceeds to 306.

Step 306:

Judgment is made as to whether or not bills for payment still remain inside the one-thousand-yen-bill box Box-C. If they remain, the operation proceeds to Step 309, and, if not, proceeds to Step 312.

Step 307:

All the bills for payment inside the ten-thousand-yen-bill box Box-E for which it was judged in Step 304 that there are remaining bills are separated one by one and are transported to the temporary pool Pool-A, and then the operation proceeds to Step 310.

Step 308:

All the bills for payment inside the five-thousand-yen-bill box Box-D for which it was judged in Step 305 that there are remaining bills are separated one by one and are transported to the temporary pool Pool-A, and the operation then proceeds to Step 310.

Step 309:

All the bills for payment inside the one-thousand-yen-bill box Box-C for which it was judged in Step 306 that there are remaining bills are separated one by one and are transported to the temporary pool Pool-A, and the operation proceeds to Step 310.

Step 310:

Judgement is made as to whether or not the total number of bills transported to the temporary pool Pool-a has reached the permissible number of bills of the temporary pool Pool-A. If the maximum number has been reached, the operation proceeds to Step 311, and, if not, returns to Step 304.

Step 311:

Bills transported to an accumulated in the temporary pool Pool-A in Steps 307 through 309 are collected in the received-bill distributing box Box-A by raising the bill-mounting plate A1, as shown in FIGS. 3C3 and 3C4. After completion of the collecting operation, the operation returns to Step 304.

Step 312:

If in Step 306 bills for payment in the ten-thousand-yen-bill box Box-E, five-thousand-yen-bill box Box-D, and one-thousand-yen-bill box Box-C have been used up, judgment is made as to whether or not bills remain in the temporary pool Pool-A. If they remain, the operation proceeds to Step 313, and, if not, this flow chart for completion of work and collection is completed.

Step 313:

As in the case of Step 311, bills transported to and accumulated to the temporary pool Pool-A in Steps 307 through 309 are collected in the received-bill distributing box Box-A by raising the bill-mounting plate A1, as shown in FIGS. 3C3 and 3C4. Then, this flow chart for completion of work and collection is completed.

Figure 9B:
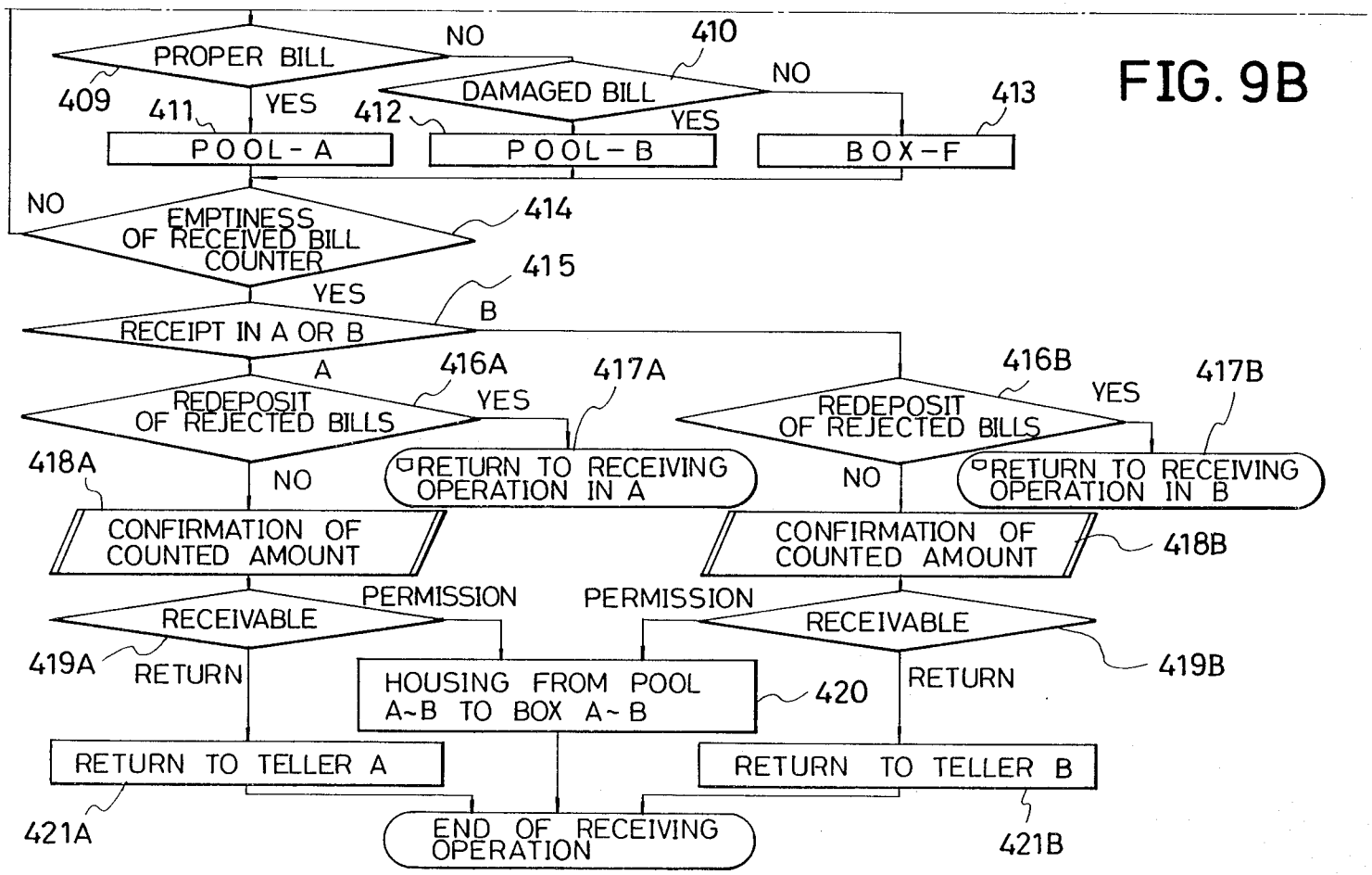

FIG. 9 shows a flow chart in the receiving mode for the circulation-type bill-receiving and dispensing machine.

Receiving Operation

When a teller A carries out a receiving operation (Step 400A), and when a teller B carries out a receiving operation (Step 400B), the operations are practically the same. Therefore, each step is described collectively.

Step 401A/401B:

When an instruction for receipt is issued, the shutter 2b-A/2b-B of the dealing port 3A/3B is opened.

Step 402A/402B:

Bills received from the customer are deposited in the dealing drum 2*a*-A/2*a*-B through the open dealing port 3A/3B. At the same time, judgment is made as to whether the bills have been deposited properly. If deposit is completed, the operation proceeds to Step 403A/403B, and, if not, remains on standby in this Step 402A/402B.

Step 403A/403B:

After the deposit of bills is completed, the shutter 2*b*-A/2*b*-B of the dealing port 3A/3B is closed.

Step 404A/404B:

Judgment is made as to whether or not the teller B/A is carrying out a receiving operation. If the teller is carrying out a receiving operation, the operation proceeds to Step 405A/405B, and, if not, proceeds to 406A/406B.

Step 405A/405B:

At the time when the teller A/B wishes to carry out a receiving operation, an indication for standby is issued, and the operation returns to Step 404A/404B.

Step 406A/406B:

The received bills placed inside the dealing drum 2*a*-A/2*a*-B are transferred from the dealing drum 2*a*-A/2*a*-B to the received-bill counter.

Step 407:

The bills inside the received-bill counter are separated and fed one by one.

Step 408:

Bills thus separated and fed are sent to the discriminating detector 7 via the received-bill handling route R1. Judgment is then made of the genuineness and type of bill, the obverse from the reverse side, damage, etc. of the bills being transported.

Step 409:

When it is judged that the bill being transported is "genuine" and "proper" (which refers to a bill which is free of stains, damage, or the like), the operation proceeds to Step 411, and if it is judged that the bill falls into the other categories, the operation proceeds to Step 410.

Step 410:

When it is judged that the bill being transported is "genuine" and "damaged" (which refers to a bill which has such defects as stains or damage), the operation proceeds to Step 412, and, if it is judged that the bill falls into the other categories, the operation proceeds to Step 413.

Step 411:

Bills which are judged to be "genuine" and "proper" in Step 409 are accumulated in the temporary pool Pool-A, and then the operation proceeds to Step 414.

Step 412:

Bills which are judged to be "genuine" and "damaged" in Step 410 are accumulated in the temporary pool Pool-B, and the operation then proceeds to Step 414.

Step 413:

The bills which were not judged to be "genuine" in Steps 409 and 410 are accumulated in a received-bill-returning box Box-F, and the operation proceeds to Step 414.

Step 414:

Judgment is made as to whether or not all the bills placed in the received-bill counter 6 have been separated and fed. Upon completion of the counting of the number of received bills, the operation proceeds to Step 415, and, if not, returns to Step 407.

Step 415:

Judgment is made as to whether the receiving operation which has proceeded up to Step 414 is being carried out by the teller A or the teller B. If the process is being carried out by the teller A, the operation proceeds to Step 416A, and if the process is being carried out by the teller B, proceeds to Step 416B.

Step 416A/416B:

In the case that no bills are returned to the received-bill-returning portion Box-F, i.e., if all the deposited bills are recognized as being "bills," and in the case that it is not necessary to redeposit the bills returned to the received-bill-returning portion Box-F to discriminate the bills and count their number, the operation proceeds to Step 418A/418B. In the case that it is necessary to redeposit the bills returned to the received-bill-returning portion Box-F to discriminate the bills and count their number, the operation proceeds to Step 417A/417B.

Step 417A/417B:

The operation returns to Step 400A/400B so as to discriminate again the bills returned to the received-bill-returning portion Box-F and to count their number.

Step 418A/418B:

The teller A/B confirms the amount of bills counted by the circulation-type bill-receiving and dispensing machine.

Step 419A/419B:

After confirming the amount of counted received bills displayed on the display (output unit 18*a*/18*b*) of the teller's machine TM-A/TM-B, the teller A/B decides whether or not the receiving operation can be made. In the case that the amount of counted received bills is the same as the amount declared by the customer (including the case in which comparison is made between the portion of the amount returned to the received-bill-returning portion Box-F and the total amount received after being manually input by the teller A/B and the amounts agree), the operation proceeds to Step 420, and, in other cases, proceeds to Step 421A/421B.

Step 420:

In the case that a receiving-permission button (not shown) is depressed in Step 419A/419B, bills accumulated in the temporary pools Pool-A and Pool-B are accumulated and housed in the received-bill distributing box Box-A and the damaged-bill box Box-B, and then this flow chart of the receiving process is completed.

Step 421A/421B:

When a received-bill-nonpermission button (not shown) is depressed in Step 419A/419B, bills accumulated in the temporary pools Pool A and Pool B are pulled outside the machine together with the temporary pool Pool-B, and a returning step is taken. Then, this flow chart of the receiving process is completed.

Figure 10B:
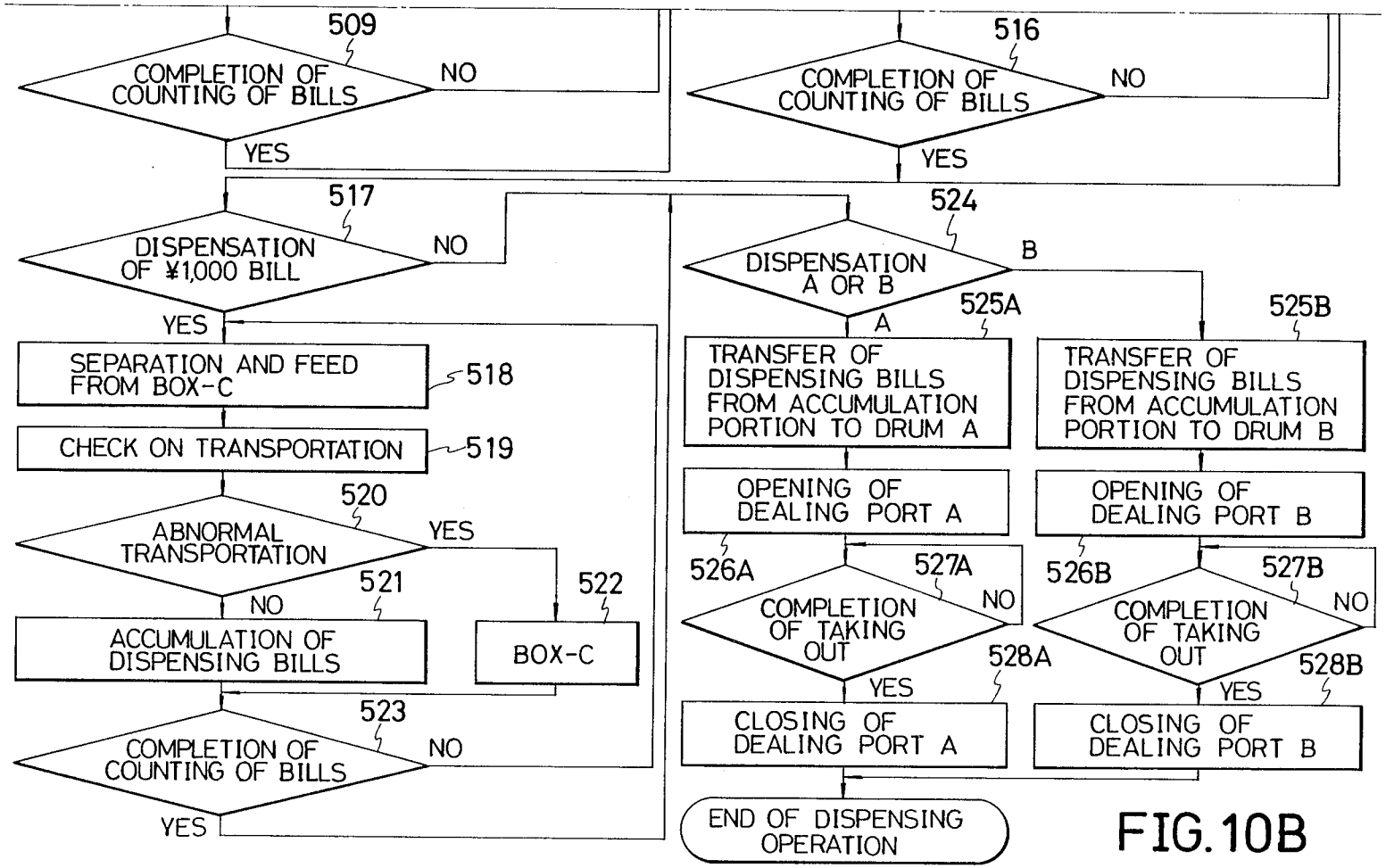

FIG. 10 shows a flow chart at the time when the circulation-type bill-receiving and dispensing machine 1 is in the dispensing mode.

Paying-out Operation

When the teller A carries out a dispensing operation (Step 500A), and when the teller B carries out a dispensing process, the operations are practically the same. Therefore, each step is described collectively.

Step 501A/501B:

When an instruction for dispensation is issued, judgment is first made as to whether the teller B/A is carrying out a dispensing operation. If the teller is carrying out a dispensing operation, the operation proceeds to Step 502A/502B, and, if not, proceeds to Step 503.

Step 502A/502B:

When the teller A/B wishes to carry out a dispensing operation, since the teller B/A is carrying out a dispensing process, an indication for standby is issued, and the operation returns to Step 501A/501B.

Step 503:

In accordance with the data for dispensation inputted by the teller's machine TM-A/TM-B, judgment is first made as to whether or not ten-thousand-yen bills need to be dispensed. If it is judged that ten-thousand-yen bills need to be dispensed, the operation proceeds to Step 504, and, if not, proceeds to Step 510.

Step 504:

Ten-thousand-yen bills are separated and fed one by one on the basis of the data for dispensation.

Step 505:

The condition of transportation of bills along the dispensing-bill handling route R5 is detected and checked at a dispensing-bill-transportation detector 14.

Step 506:

When the condition of bill transportation is normal, the operation proceeds to Step 507, and, if the condition of transportation is abnormal, proceeds to Step 508.

Step 507:

Bills transported normally are transported as paying-out bills to the end of the dispensing-bill handling route R5 and accumulated in a dispensing-bill accumulating portion 15. Then, operation proceeds to Step 509.

Step 508:

Bills that are judged as coming under abnormal transportation are sent to the distributing route R2 by means of a distributing fork F7 via dispensation-retry route R6, and are then returned to the ten-thousand-yen-bill box Box-E by means of the distributing fork F2. Then, operation proceeds to Step 509.

Step 509:

Judgment is made as to whether ten-thousand-yen-bills have been fed normally in the number based on the data for dispensation. When the counting of the ten-thousand-yen bills is completed, the operation proceeds to Step 510, and, if not, returns to Step 504 so as to continue the separation and feeding of the ten-thousand-yen bills.

Step 510:

As in the case of Step 503, judgment is made as to whether or not it is necessary to dispense five-thousand-yen bills. If it is judged that the dispensation of five-thousand-yen bills is necessary, the operation proceeds to Step 511, and, if not, proceeds to Step 517.

Step 511:

Five-thousand-yen bills in the five-thousand-yen-bill Box-D are separated and fed one by one on the basis of the data for dispensation.

Step 512:

The condition of transportation of bills transported along the dispensing-bill handling route R5 is detected and checked at the dispensing-bill-transportation detector 14.

Step 513:

If the condition of bill transportation is normal, the operation proceeds to Step 514, and if the condition of transportation is abnormal, the operation proceeds to Step 515.

Step 514:

Bills that are transported normally are transported as dispensing bills to the end of the dispensing-bill handling route R5 and are accumulated in the dispensing-bill-accumulating portion 15. Then, operation proceeds to Step 516.

Step 515:

Bills that are judged as coming under abnormal transportation are sent to the distribution route R2 by means of the distributing fork F7 via a dispensation-retry route R6, and are returned to the five-thousand-yen-bill box Box-D by means of the distributing fork F3. Then, operation proceeds to Step 516.

Step 516:

Judgment is made as to whether or not five-thousand-yen bills have been sent normally in the number based on the data for dispensation. If the counting of the five-thousand-yen bills is completed, the operation proceeds to Step 517, and, if not, returns to Step 511 so as to continue the separation and feeding of the five-thousand-yen bills.

Step 517:

As in the case of Steps 503 and 510, judgment is made as to whether or not it is necessary to dispense one-thousand-yen bills. If it is judged that the dispensation of one-thousand-yen bills is necessary, the operation proceeds to Step 518, and, if not, proceeds to Step 524.

Step 518:

One-thousand-yen bills in the one-thousand-yen-bill box Box-C are separated and fed one by one on the basis of the data for dispensation.

Step 519:

The condition of bill transportation along the dispensing-bill handling route R5 is detected and checked at the dispensing-bill transportation detector 14.

Step 520:

When the condition of bill transportation is normal, the operation proceeds to Step 521, and, when the condition of bill transportation is abnormal, the operation proceeds to Step 522.

Step 521:

Bills transported normally are transported as dispensing bills to the end of the dispensing-bill handling route R5 and are accumulated in the dispending-bill accumulating portion 15. Then, operation proceeds to Step 523.

Step 522:

Bills that were judged as coming under abnormal transportation are sent to the distribution route R2 by means of the distributing fork 7 via the dispensing-bill retry route R6, and are returned to the one-thousand-yen-bill box Box-C by means of the distributing fork F4. Then, operation proceeds to Step 523.

Step 523:

Judgment is made as to whether or not one-thousand-yen bills have been fed out normally in the number based on dispensation data. When the counting of the number of one-thousand-yen bills is completed, the operation proceeds to Step 524 and, if not, returns to Step 518 so as to continue the separation and feeding of one-thousand-yen bills.

Step 524:

Judgment is made as to whether the dispensing operation which has proceeded up to this Step 524 is being carried out by the teller A or the teller B. If the teller A is carrying out the operation, the operation proceeds to Step 525A, and if the teller B is carrying out the operation, the operation proceeds to Step 525B.

Step 525A/525B:

Bills accumulated in the dispensing-bill accumulating portion 15 as dispensing bills are transferred from the dispensing-bill accumulating portion 15 to the dealing drum *2a*-A/*2a*-B.

Step 526A/526B:

After transferring the bills to the dealing drum *2a*-A/*2a*-B, the shutter *2b*-A/*2b*-B is driven to open the dealing port 3A/3B.

Step 527A/527B:

Judgment is made as to whether or not the teller A/B has taken out the bills inside the dealing drum *2a*-A/*2a*-B. When he has finished taking them out, the operation proceeds to Step 528A/528B. When he has not finished taking them out, the operation remains on standby at this Step 527A/527B.

Step 528A/528B:

After the taking out of bills is completed, the shutter *2b*-A/*2b*-B of the dealing port 3A/3B is closed, and this completes the flow chart for the handling of the dispensing operation.

Moreover, the dispensing-bill handling operation is immediately interrupted should any abnormalities occur which are not shown in this flow chart for handling the dispensing bills, such as jamming occuring in that portion of the dispensing-bill handling route R5 following the dispensing-bill transportation detector 14, or a case in which bills that should be transferred to the dispensing-retry route R6 are transported by mistake to the dispensing-bill accumulating portion 15. At the same time, bills that had, up until then, been accumulated in the dispensing-bill accumulating portion 15 are sent from this dispensing-bill accumulating portion 15 to the received-bill counter via the dealing drum *2a*-A/*2a*-B, and are further distributed to and collected in each box Box-C to Box-E.

In case where different operations by tellers A and B are performed simultaneously, that is, for example, when the teller A carries out the receiving operation and simultaneously the teller B carries out the dispensing operation, although such simulteneous, different operations are not indicated in the receiving flow chart as shown in FIG. 9 and the dispensing flow chart as shown in FIG. 10, each can be carried out simultaneously and independently without any interruption of different operations.

In other words, in such a case, the operation by the teller A occupies the dealing opening mechanism 2A, the received bill counter 6, the received bill treatment route R1, the received bill distributing route R3, the temporary pools Pool-A and Pool-B, and the received bill returning portion Box-F (in addition, the received bill distributing box Box-A, the damaged bill box Box-B) during the receiving operation while the operation by the teller B occupies ¥10,000 box Box-E, ¥5,000 box Box-D, ¥1,000 box Box-C, the dispensing treatment route R5, the dispensing bill accumulating portion 15, the dealing opening mechanism 2B (in addition, the dispensation-retry route R6, distribution route R2) during the dispensing treatment. Consequently, the receiving operation and the dispensing operation can be carried out.

Figure 11:
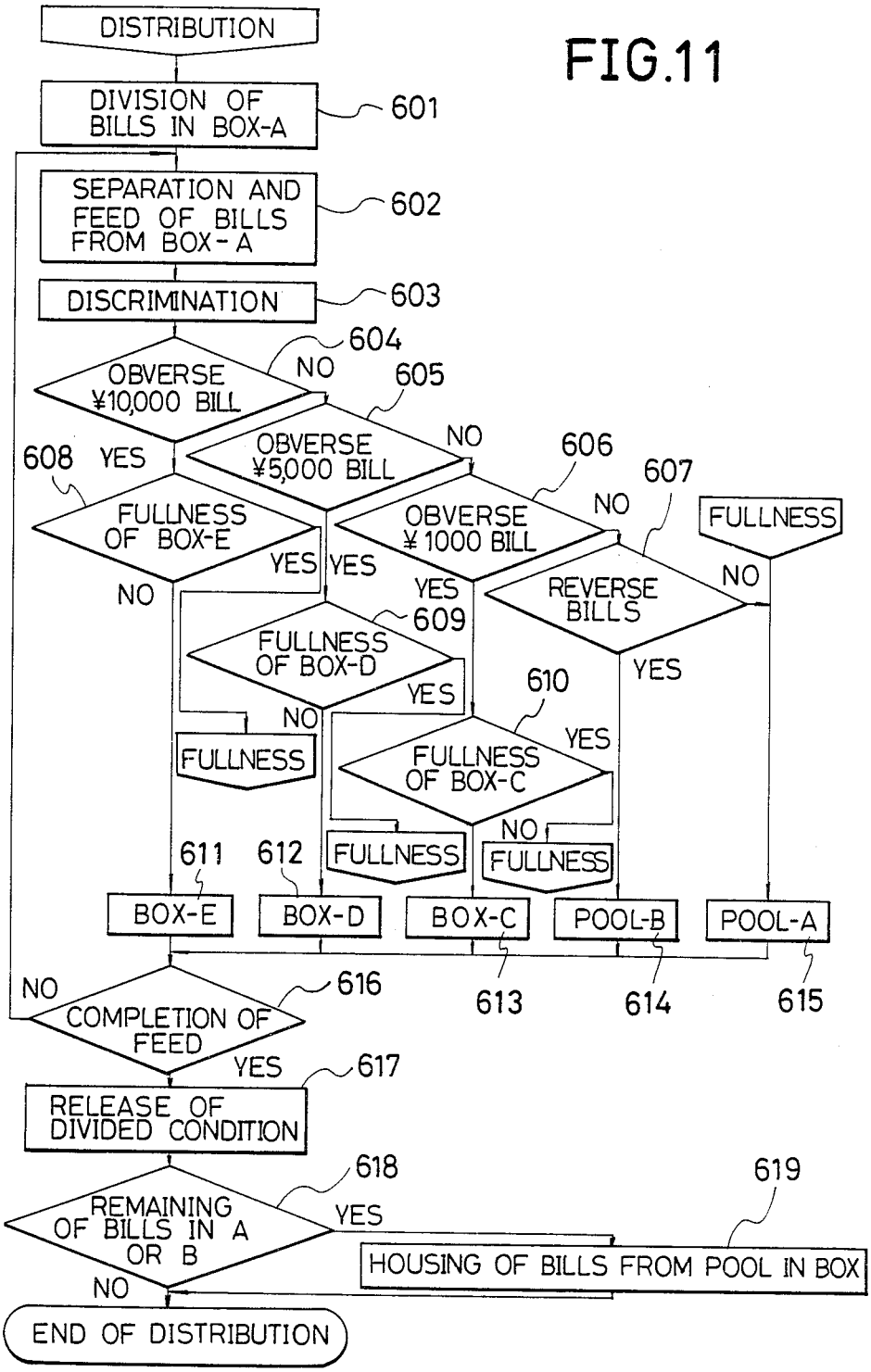
FIG. 11 is a flow chart in the distributing mode.

FIG. 11 shows a flow chart when the circulating-type bill receiving and dispensing machine is in the distributing mode.

Distributing Operation

Step 601:

Before distributing bills in the received-bill distributing box Box-A to each box Box-C to Box-E, bills in the received-bill distributing box Box-A are divided into appropriate volumes by means of the dividing fork DF.

Step 602:

Bills to be distributed which were divided into appropriate volumes by means of the dividing fork DF are separated and fed one by one.

Step 603:

Bills thus separated and fed are sent to the discriminating detector 7 via the dispensing-bill handling route R5 and the distribution and transfer route R7, and the type of bill and the obverse from the reverse side of the bill being transported is judged.

Step 604:

If a ten-thousand-yen bill showing the obverse side is detected among the bills being transported, the operation proceeds to Step 608, and, in other cases, proceeds to Step 605.

Step 605:

If a five-thousand-yen bill showing the obverse side is detected among the bills being transported, the operation proceeds to Step 609, and, in other cases, proceeds to Step 606.

Step 606:

If a one-thousand-yen bill showing the obverse side is detected among the bills being transported, the operation proceeds to Step 610, and, in other cases, proceeds to Step 607.

Step 607:

If a bill showing the reverse side is detected among the bills being transported, the operation proceeds to Step 614, and, in other cases, proceeds to Step 615.

Step 608:

Judgment is made as to whether or not the ten-thousand-yen-bill box Box-E is filled with bills (or is close to full). if filled, the operation proceeds to Step 615 and, if not, proceeds to Step 611.

Step 609:

As in the case of Step 608, Judgment is made as to whether or not the five-thousand-yen-bill box Box-D is filled with bills (or close to full). If filled, the operation proceeds to Step 615 and, if not, proceeds to Step 612.

Step 610:

As in the case of Step 608, judgment is made as to whether or not the one-thousand-yen bill box Box-C is filled with bills (or close to full). If filled, the operation proceeds to Step 615 and, if not, proceeds to Step 613.

Step 611:

When it is judged in Step 604 that the bill is a ten-thousand-yen bill showing the obverse side, and judged in Step 608 that the ten-thousand yen-bill box Box-E is not filled, the bill being transported is housed and accumulated in the ten-thousand-yen-bill box. Then, the operation proceeds to Step 616.

Step 612:

When it is judged in Step 605 that the bill is a five-thousand-yen bill showing the obverse side, and judged in Step in 609 that the five-thousand-yen-bill is not filled, the bill being transported is housed and accumulated in the five-thousand-yen-bill box Box-D. Then, the operation proceeds to Step 616.

Step 613:

When it is judged in Step 606 that the bill is a one-thousand-yen bill, and judged in Step 610 that the one-thousand-yen-bill box is not filled, the bill being transported is housed and accumulated in the one-thousand-yen-bill box Box-C. Then, operation proceeds to Step 616.

Step 614:

Of the bills being transported that failed to fall under the requirements in any of the Steps 604 to 606, those which were judged to be reverse are accumulated in the temporary pool Pool-B. Then, operation proceeds to Step 616.

Step 615:

Bills which were not even judged in Step 607 as being reverse, i.e., those falling under the case of abnormal transportation, and bills which were judged in Steps 608 to 610 as being incapable of being housed and accumulated as each the boxes Box-C to Box-E is filled are accumulated in the temporary pool Pool-A. Then, operation proceeds to Step 616.

Step 616:

Judgment is made as to whether all the bills to be distributed that have been divided in appropriate volumes by means of the dividing fork DF in Step 601 have been separated and fed. If distribution is completed, the operation proceeds to Step 617, and, if not, returns to Step 602.

Step 617:

The dividing fork DF as it is inserted inside the received-bill distribution box Box-A is pulled out from the received-bill distributing box Box-A and is returned to its original position (refer to FIG. 3C2).

Step 618:

Judgment is made as to whether or not any bills which were not distributed into the boxes Box-C to Box-E remain in the temporary pool Pool-A or Pool-B. If any bills remain in any of the temporary pools Pool-A and Pool-B, the operation proceeds to Step 619, and, if not, this flow chart for the distributing operation is completed.

Step 619:

If, in Step 618, any bills remain in the temporary pool Pool-A or Pool-B, the bills that were not distributed are collected by raising the bill-mounting plate A1, as shown in FIGS. 3C3 and 3C4. This completes the flow chart for the distributing operation.

In addition, in case that any abnormalities such as power interruption occur during the operation of this circulation-type bill receiving and dispensing machine, bills along the route related to the receiving operation, namely, the received-bill counter 6, the received-bill handling route R1, the temporary pools Pool-A and Pool-B, and the received-bill returning box Box-F are removed. Then, bills along the route related to the dispensing operation, namely, the dispensing-bill handling route R5, the dispensation entry route R6, the distributing route R2, and the dispensing-bill accumulating portion 15 are removed and collected. In other words, as in the case of handling of abnormalities in dispensation at the time of the bill-dispensing operation, bills in the dispensing-bill accumulating portion 15 are sent to the received-bill counter 6 through the dealing drum 2*a*-A/2*a*-B and, furthermore, the bills can be distributed from the received-bill counter 6 to each box Box-C to Box-E to effect the controlling of collection.

Also, if the aforementioned conditions occur in the distribution mode, there is a high possibility that the destination of bills on the received-bill handling route R1 preceding the discriminating detector 7 as well as on the distributing route R2 becomes unclear. Therefore, at least bills on the distributing route R2 are transferred to the received-bill distributing route R3 via the mechanical clearing route R4, while bills on the received-bill handling route R1 preceding the distributing route R2 are transferred directly to the received-bill distributing route R3 so as to control the collection of bills in the temporary pool Pool-A.

As described above, since the received-bill handling route in which received-bills are discriminated and the dispensing-bill handling route for transporting dispensing-bills are arranged so as not to intersect each other or overlap, the present invention has an effect that a bill-dispensing operation can be effected even when a bill-receiving operation is being carried out. The apparatus according to the invention can be incorporated, for instance, into a system in which two tellers at a counter of a financial institution such as a bank perform bill receiving and dispensing operations simultaneously using one circulation-type bill receiving and dispensing machine.

What is claimed is:

1. A circulation-type bill receiving and dispensing machine comprising:

two dealing ports, dealing port means including two dealing drums communicating with said two dealing ports, respectively, a receiving port for selectively communicating with either one of said two dealing drums to receive bills therefrom, a dispensing port for selectively communicating with either one of said two dealing drums to dispense bills thereto, a received-bill handling route for receiving bills from said receiving port and for separating, transporting, and discriminating the bills, and then distributing the bills in accordance with the results of the discrimination, a plurality of boxes for accommodating therein the bills distributed by said received-bill handling route and for feeding out bills, and a dispensing-bill handling route for receiving the bills fed out from said plurality of boxes to transfer the bills to said dispensing port, said received-bill handling route and said dispensing-bill handling route being arranged to avoid intersecting each other so that a receiving operation and a dispensing operation can be performed simultaneously.

2. A machine according to claim 1, wherein the machine has a receiving mode, a dispensing mode, and a distibuting mode.

3. A machine according to claim 2, wherein, at the time of the distribution mode, said received-bill handling route distributes bills according to the type of money into said plurality of boxes.

4. A machine according to claim 2, wherein, in the distribution mode, said received-bill handling route distributes obverse bills according to the type of bill into said plurality of boxes, and at the same time, collecting bills in a received-bill distributing box after inverting reverse bills.

5. A machine according to claim 2, wherein said distribution mode is set automatically when the number of bills housed in said boxes falls below a predetermined number of sheets to effect the distribution of a fixed number of bills.

6. A machine according to claim 5, wherein said distribution mode is set automatically at a time other than when either said receiving mode or said dispensing mode is selected to effect the distribution of a fixed number of bills.

* * * * *